US009580920B1

(12) United States Patent
Yingling

(10) Patent No.: US 9,580,920 B1
(45) Date of Patent: Feb. 28, 2017

(54) HARDWARE MOUNTABLE BLOCKOUT APPARATUS AND STRUCTURAL MEMBER INTEGRATING THE SAME

(71) Applicant: Jeffrey Yingling, Forest Hill, MD (US)

(72) Inventor: Jeffrey Yingling, Forest Hill, MD (US)

( * ) Notice: Subject to any disclaimer, the term of this patent is extended or adjusted under 35 U.S.C. 154(b) by 0 days.

(21) Appl. No.: 14/590,297

(22) Filed: Jan. 6, 2015

(51) Int. Cl.
*E04G 15/00* (2006.01)
*E04G 15/06* (2006.01)
*E04B 5/48* (2006.01)
*E04C 3/20* (2006.01)

(52) U.S. Cl.
CPC ..... *E04G 15/06* (2013.01); *E04B 5/48* (2013.01); *E04C 3/20* (2013.01)

(58) Field of Classification Search
CPC ..... E04B 5/48; E04G 15/06; E04G 15/061; E04G 15/063; E04G 15/065; E04G 15/066; E04G 15/068; E04C 3/20
USPC ..... 52/220.8, 220.1–220.7
See application file for complete search history.

(56) References Cited

U.S. PATENT DOCUMENTS 1,072,361 A 9/1913 Rickman
2,156,639 A 5/1939 Powell
2,953,874 A 9/1960 Kindorf
3,093,933 A * 6/1963 Slingluff ..... E04B 5/40 138/92
3,405,834 A * 10/1968 Butler ..... E04B 5/48 174/57
4,018,416 A * 4/1977 Diener ..... E04G 15/061 249/177
4,315,393 A 2/1982 Schack et al.
4,368,606 A 1/1983 Hoshino
4,443,992 A 4/1984 Shechter
4,637,175 A 1/1987 Froening et al.
4,842,240 A 6/1989 Pickett
4,888,922 A 12/1989 Lancelot
5,245,806 A 9/1993 Baur et al.
5,405,119 A * 4/1995 Maguire ..... B28B 7/18 249/183
5,729,938 A * 3/1998 Tobias ..... E04B 5/48 248/56
5,845,441 A 12/1998 Swartz
6,341,452 B1 1/2002 Bollinghaus
6,725,611 B2 * 4/2004 DeFiglio ..... E04G 15/061 185/3
7,127,859 B2 10/2006 Domizio
8,003,889 B2 8/2011 Turcovsky
(Continued)

*Primary Examiner* — Patrick Maestri
(74) *Attorney, Agent, or Firm* — Rosenberg, Klein & Lee

(57) ABSTRACT

A blockout apparatus for preserving a through passage in a structural member formed thereabout is provided. The blockout apparatus comprises a tubular body portion having first and second ends defining mouth openings and an intermediate section extending therebetween to define a longitudinal through passage. The tubular body portion includes a gasket flange formed at least partially about each of the first and second end mouth openings to project transversely outward therefrom. A hardware mounting portion is integrated with the tubular body portion, which hardware mounting portion defines an engagement base disposed in open communication with the through passage. The engagement base is structurally augmented relative to the tubular body portion to retentively engage preselected mounting hardware for weight bearing support of an implement therefrom.

11 Claims, 12 Drawing Sheets

(56) References Cited

U.S. PATENT DOCUMENTS

| | | | |
|---|---|---|---|
| 2003/0172602 | A1 | 9/2003 | DeFreitas |
| 2010/0000173 | A1 | 1/2010 | Thompson |

* cited by examiner

HARDWARE MOUNTABLE BLOCKOUT APPARATUS AND STRUCTURAL MEMBER INTEGRATING THE SAME

BACKGROUND OF THE INVENTION

The present invention is generally directed to a blockout apparatus for integration in a structural member which preserves a through passage in the structural member while providing built in support for weight bearing hardware. More specifically, the present invention is directed to such blockout apparatus having integrated measures conveniently accessible to a user for stable and secure mounting of certain weight bearing hardware directly thereon, when the blockout apparatus is incorporated within a structural member.

Various prefabricated structural members formed of concrete or other such materials known in the art are widely used in various applications. Examples of these structural members include modular forms molded into particularly configured units, such as the so-called T-beam forms, used as building blocks in the construction of various building structures. Like structural members of numerous other type, these T-beam forms generally include a planar top panel and one or more vertical beams formed underneath the top panel to project vertically downward therefrom (to give the structural member/form a "T-beam" sectional profile). The vertical beam typically projects downward from a mid-portion of the top panel and extends underneath along substantially the full length of its bottom surface.

In substantial building structures like parking garages and the like, numerous concrete T-beam structural forms of this type are arranged and assembled together so that their top panels collectively form a ceiling for one level of the building and, if necessary, a flooring base for the elevated level immediately above. The vertical beams in a row of assembled structural forms then align to collectively define supporting joist structures for the overall surface defined overhead by the top panels of the assembled forms.

Much like flooring joists used in traditional construction to provide cross-run support underneath subfloor boards, a series of supporting joists run parallel underneath the top panel surface being supported. Various pipes, cable, conduits, and other such implements required to meet the mechanical, electrical, plumbing (MEP) needs of the given building structure are routed through the vertical beams of assembled T-beam forms—accommodated through cross openings, or passages, pre-formed therein. Typical concrete T-beam structural forms known in the art are provided with one or more of these cross-passages prefabricated through their vertical beams.

The cross-passages are preserved by tubular blockout devices incorporated into the structural members. In the case of molded structural members like concrete T-beam forms, the tubular blockout devices are placed suitably in a given mold prior to the concrete's pouring. The blockout devices then remains embedded within cured concrete, each preserving a cross-passage for the resulting structural form.

When a collection of such structural forms having cross passages are arranged and assembled together, the cross passages provide portals for freely running the various MEP implements transversely through intervening vertical members. Building codes and technical standards applicable to given applications, however, invariably require any extended run of such implements to be adequately secured to a stabilizing structure at each incremental span along the run. It is not enough that extended runs of implements pass unimpeded through the vertical beams. They must be mounted by appropriate hardware to a stable nearby structure.

In the case of electrical cables that are run along pipe-like conduits passed through the structural forms' cross passages, this requires a user to first install one or more securement anchors into the nearby structural surface to establish mounting points for the required hanging hardware. Typically, the securement anchors must be installed into the concrete surface of the top panel(s) spanning the distance between two spaced vertical beams.

This presents a number of drawbacks. First, installing a securement anchor normally requires either drilling or other impact penetration of the overhead ceiling surface (formed by the concrete top panel surface). The user is not only required to operate extraneous tools that he/she may not otherwise need to operate, it consumes considerable time which, when repeated for every incremental span of an extended conduit run, accumulates to a significant delay in completing installation. The task also requires high dexterity and strained effort to carry out. What is more, the overhead drilling and hammering process creates potentially hazardous puffs of dusty debris which in addition to requiring inconvenient cleanup exposes the user to respiratory and optical contamination, and injury from falling pieces of residual debris. Penetrating the concrete material also creates unnecessary points of possible weakening and potential compromise in the concrete form itself.

There is therefore a need for measures to simplify, speed up, and abate if not eliminate the undue hazards in the process of installing and securing continuous runs of such implements as pipes, cables, conduits, and the like through intervening portions of various structural members. There is a need for such measures which afford users convenient built in measures to accommodate the secure mounting of hardware to hold such implements passed through the structural members. There is a need for such measures which obviate the need for users to separately install points of securement on which to safely mount requisite hanging/supporting hardware.

SUMMARY OF THE INVENTION

It is an object of the present invention to provide an apparatus having convenient built in measures for securely mounting hardware to hold various implements traversing a structural member.

It is another object of the present invention to provide an apparatus which reliably preserves a through passage in a structural member while providing an integrated mounting base for supporting various weight bearing hardware coupled thereto.

It is yet another object of the present invention to provide a structural member integrated with a blockout apparatus which reliably preserves a through passage in a structural member while providing an integrated mounting base for supporting various weight bearing hardware coupled thereto.

These and other objects are attained in a blockout apparatus for preserving a through passage in a structural member formed thereabout. The blockout apparatus comprises a tubular body portion having first and second ends defining mouth openings and an intermediate section extending therebetween to define a longitudinal through passage. The tubular body portion includes a gasket flange formed at least partially about each of the first and second end mouth openings to project transversely outward therefrom. A hardware mounting portion is integrated with the tubular body portion, which hardware mounting portion defines an engagement base disposed in open communication with the through passage. The engagement base is structurally augmented relative to the tubular body portion to retentively engage preselected mounting hardware for weight bearing support of an implement therefrom.

A blockout apparatus is formed in accordance with an exemplary embodiment of the present invention for preserving a through passage in a vertical beam beneath a top panel of a T-beam structural member molded thereabout. The blockout apparatus comprises a tubular body portion having first and second ends defining mouth openings and an intermediate section extending therebetween to define a longitudinal through passage. The tubular body portion includes a gasket flange formed at least partially about each of the first and second end mouth openings to project transversely outward therefrom. The intermediate section includes top and bottom walls spaced apart by a pair of laterally spaced side walls extending therebetween. A hardware mounting portion is integrated with the tubular body portion, which hardware mounting portion defines at least one engagement base having a surface arranged in substantially coplanar alignment with the top panel of the T-beam structural member and disposed in open communication with the through passage. The engagement base is structurally augmented relative to the tubular body portion to retentively engage preselected mounting hardware for weight bearing support of an implement therefrom.

A T-beam structural member having an embedded blockout apparatus is formed in accordance with certain other exemplary embodiments of the present invention for maintaining a through passage therein. The T-beam structural member comprises a top panel and a vertical beam formed beneath the top panel to extend transversely therefrom. A tubular body portion is embedded in the vertical beam, and is formed with first and second ends defining mouth openings and an intermediate section extending therebetween to define a cross passage through the vertical beam portion. The tubular body portion includes a gasket flange formed at least partially about each of the first and second end mouth openings to project transversely outward therefrom against an outer surface of the vertical beam. The intermediate section includes top and bottom walls spaced apart by a pair of mutually spaced side walls extending therebetween. A hardware mounting portion is integrated with the tubular body portion, which hardware mounting portion defines at least one engagement base having a surface arranged in substantially coplanar alignment with the top panel and disposed in open communication with the cross passage. The engagement base is structurally augmented relative to the tubular body portion to retentively engage preselected mounting hardware for weight bearing support of an implement therefrom.

DETAILED DESCRIPTION OF THE PREFERRED EMBODIMENTS

Generally, an apparatus formed in accordance with certain exemplary embodiments of the present invention serves to blockout a through passage, or cross passage, in a structural member formed thereabout. The blockout apparatus may be integrated with the structural member during a molding process, if the structural member is of molded form, such as various prefabricated concrete structural forms known in the art for use in construction. The blockout apparatus may be integrated into the given structural member by any suitable measures known in the art consistent with that structural member's type (molded, assembled, or the like) and configuration.

In accordance with certain aspects of the present invention, the blockout apparatus is built into the given structural member. The apparatus is configured to both preserve a crossing through passage in that structural member while providing a stable integrated mounting base for the convenient, direct mounting of various weight bearing hardware thereto. The hardware may be directly engaged to the mounting base so that the weight of pipes, cables, conduits, or other such implements/articles that may be required for a given application is supported in stable and reliable manner.

Figure 1:
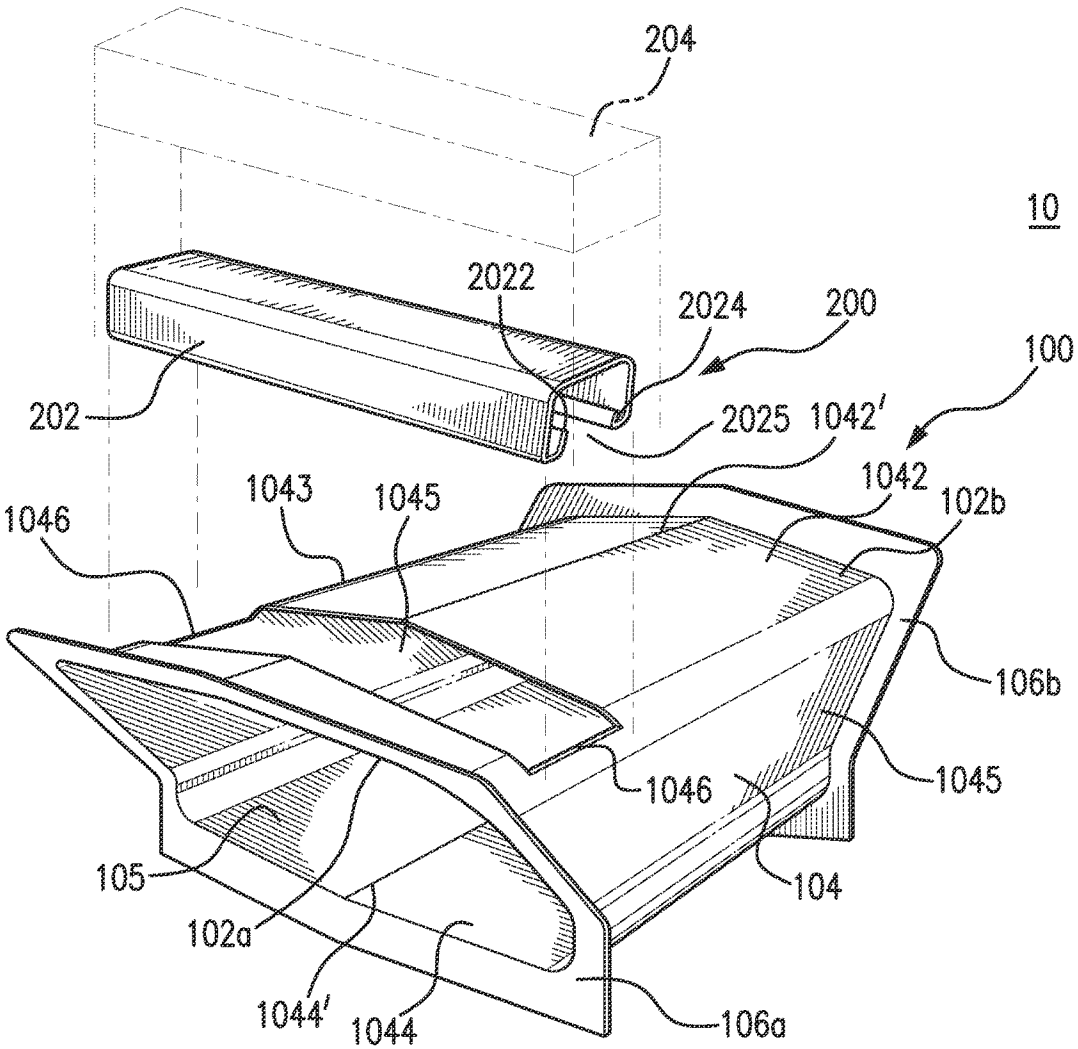
FIG. 1 is an exploded upper frontal perspective view of an apparatus formed in accordance with one exemplary embodiment of the present invention.
Figure 8:
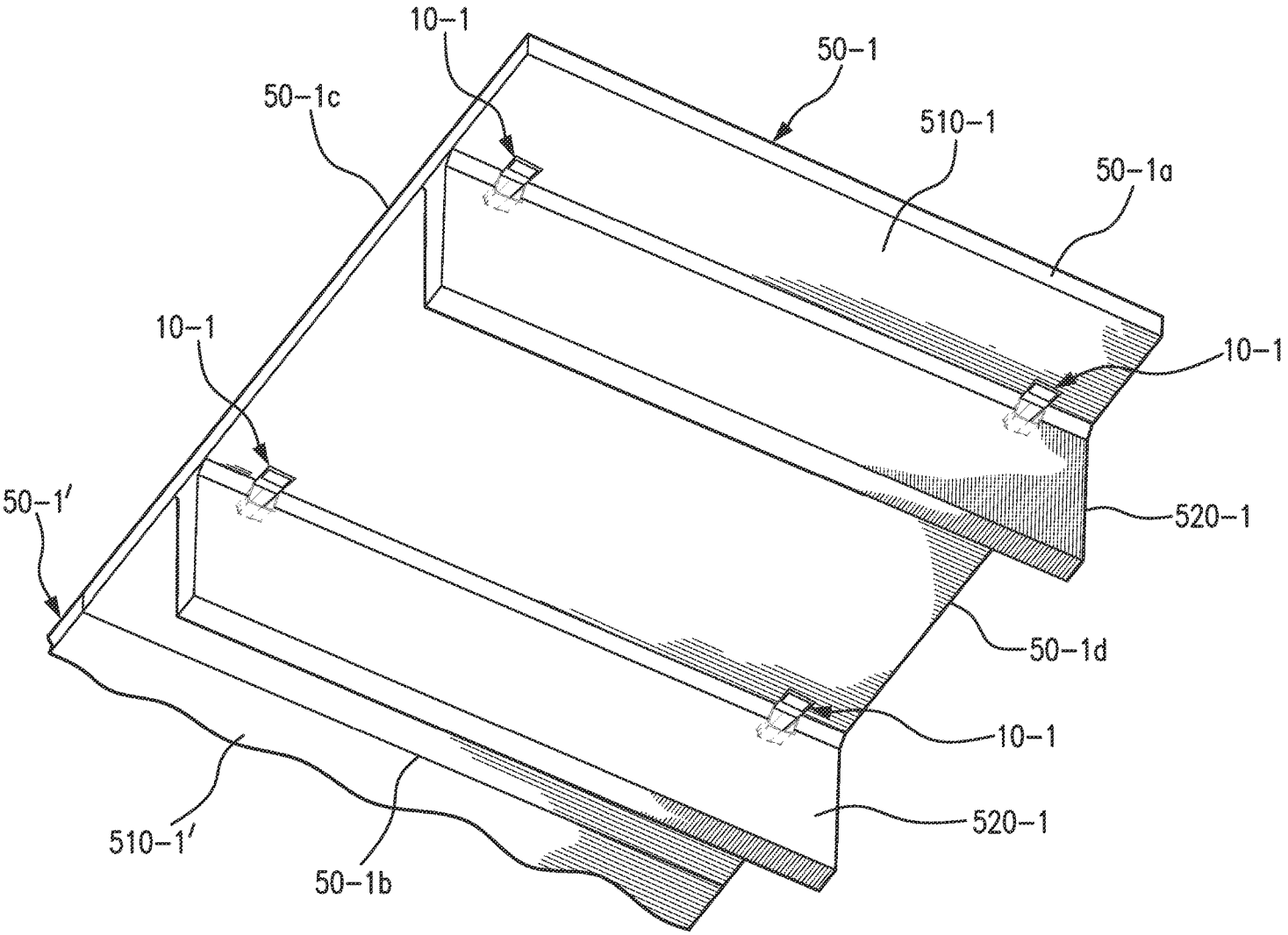
FIG. 8 is a lower frontal perspective view of a structural member formed in accordance with an exemplary embodiment of the present invention having a plurality of apparatuses implemented as shown in FIG. 6B integrated therein; and, FIG. 9 is a perspective view of a plurality of structural members formed in accordance with another exemplary embodiment of the present invention having with a plurality of apparatuses implemented as shown in FIG. 1 integrated therein, shown installed in an illustrative parking garage application, with hanging hardware mounted thereto to hold a continuous run of structural member-traversing implement segments.

Referring now to FIG. 1, a blockout apparatus 10 formed in accordance with one exemplary embodiment of the present invention is illustrated. In this illustrative embodiment, the blockout apparatus 10 is configured for integration into a molded structural member, such as so-call T-beam forms. Typically, such T-beam forms are molded from concrete or other suitable material composition known in the art to include a substantially planar top panel from which one or more joist-like vertical beams extend underneath. An example of one structural member of this T-beam form type is illustrated in FIG. 8 described in following paragraphs with reference to certain other embodiments of the present invention.

Blockout apparatus 10 may be formed with various combinations of shape, relative dimension, and other such features of structural configuration suitable for the intended application. But in the illustrated embodiment, the blockout apparatus 10 generally includes a tubular body portion 100 and a hardware mounting portion 200. The tubular body and hardware mounting portions 100, 200 are configured for embedding within the upper regions of vertical beams—of approximately Y-shaped sectional profile in this example. This configuration is often found in widely employed concrete T-beam forms used for constructing above-ground levels of multi-level building structures such as parking garages, arenas, and the like. The tubular body portion 100 includes first and second ends 102*a*, 102*b* between which an intermediate section 104 longitudinally extends. The intermediate section 104 defines a through passage 105' openly accessed via mouth openings defined at respective longitudinal end 102*a*, 102*b*.

The tubular body portion 100 is typically formed of a plastic-based material for its combination of cost and performance (including strength, rigidity, weight, durability, and compatibility with other materials). But in other embodiments and implementations, the portion 100 may be formed of one or more other suitable materials known in the art.

The hardware mounting portion 200 in this embodiment includes an engagement base 202 accessed through a window 1045 formed in the roof-forming top wall of the tubular body portion's intermediate section 104. The engagement base 102 is formed in this embodiment by a bracket-type member to which certain mounting hardware may be directly hooked for stable mechanical coupling. For example, the engagement base 202 may be formed as a metallic strut channel member that defines a recessed channel 2025 between a pair of opposed lips 2022, 2024. The structure thus forms a retention track along which the given mounting hardware may be slidably located and locked for supporting the different implements.

The engagement base 202 and intermediate section 104 of the tubular body portion together provide a stable base of support when loaded by various implements and their mounting/hanging hardware. They are of sufficient material composition and/or structural properties to accommodate the expected loading during use in the intended application. While they may be formed of the same or different materials depending on the particular implementation, each is formed of a material having a suitable combination of strength, rigidity, toughness, and weight required for convenient yet reliable mounting of the mounting/hanging hardware directly thereto. Any suitable material known in the art capable of providing such combinations of properties may be used for these and other parts of the blockout apparatus 10.

Preferably, though not necessarily, the engagement base 202 may be formed of a metallic composition that withstands deflection and failure when its retention channel is engaged by weight bearing hardware. When largely embedded within a structural member, the conforming support provided by the surrounding material may afford the use of materials having lesser density and weight. Any material combination known in the art suitable for the requirements of the intended application may be employed this and other parts of the hardware mounting portion 200.

Because blockout apparatus 10 in the illustrated embodiment is to be embedded within a molded structural member, it is preferably formed with a gasket flange 106*a*, 106*b* that flares outward from each of the mouth openings at the longitudinal ends of the tubular body portion 100. Preferably, the gasket flange 106*a*, 106*b* at each end extends 102*a*, 102*b* continually along the side, top, and bottom edges of the intermediate section 104 at that end. The gasket flanges 106*a*, 106*b* serve during the molding process to keep the flow of uncured material poured into a given structure member mold from infiltrating the through passage 105. The gasket flanges 106*a*, 106*b* also provide convenient peripherally-flared surfaces that engage the surface of the surface member peripherally surrounding the mouth opening at each end 102*a*, 102*b* of the tubular body portion 100. This helps to guide the tubular body portion's longitudinally centered positioning within the structural member's vertical beam.

Other features additionally facilitate use of the apparatus 10 as a through passage-preserving insert within a mold during the structural member's molded fabrication. The angled contours of the tubular body intermediate section's side walls 1043, 1045 and top/bottom walls 1042, 1044 reinforce against excessive deflection and eventual failure under the weight of the concrete or other mold material that is poured into the mold thereabout. For example, the longitudinally peaked structure of the top and bottom walls 1042, 1044 afford respective intermediate ridges 1042', 1044' that strengthen and reinforce the top and bottom walls 1042, 1044 from collapsing into the through passage 105 under pressure from the surrounding mold material.

In this regard, the rigid strut channel member 202 situated within the window opening 1045 set on the ledges 1046 aids in the structural bracing of the tubular body portion 100 against undue deflection and collapse during the molding process. The peripherally looped gasket flanges 106*a*, 106*b* in this embodiment likewise add to the tubular body portion's structural cross bracing against such deflection and collapse.

As shown, the engagement base 202 is seated within the window opening 1045 of the tubular body portion 100, supported by the ledges 1046. The engagement base 202 extends transversely to span the window opening 1045 preferably across nearly the full transverse width of the top wall 1042 of the intermediate section 104. The retention track defined by the engagement base's strut channel in this embodiment then extends in part over the through passage 105 near a mouth opening of the adjacent end 102*a*. The retention track is then readily accessible through that end's mouth opening and through passage 105. Although not shown, another engagement base 202 may be similarly provided at the other end 102*b* through a corresponding window opening formed in the tubular section 104 there, if necessary, in certain alternate embodiments of apparatus 10.

The hardware mounting portion 200 preferably also includes in this embodiment a suitable covering 204 formed over and about the engagement base 202 so as to guard against mold material infiltration into through passage 104 (through/about the engagement base 202 exposed through the window opening 1045). Any suitable measures known in the art may be employed for this covering 204, so long as they are consistent with the particular requirements of the intended application.

Figure 2:
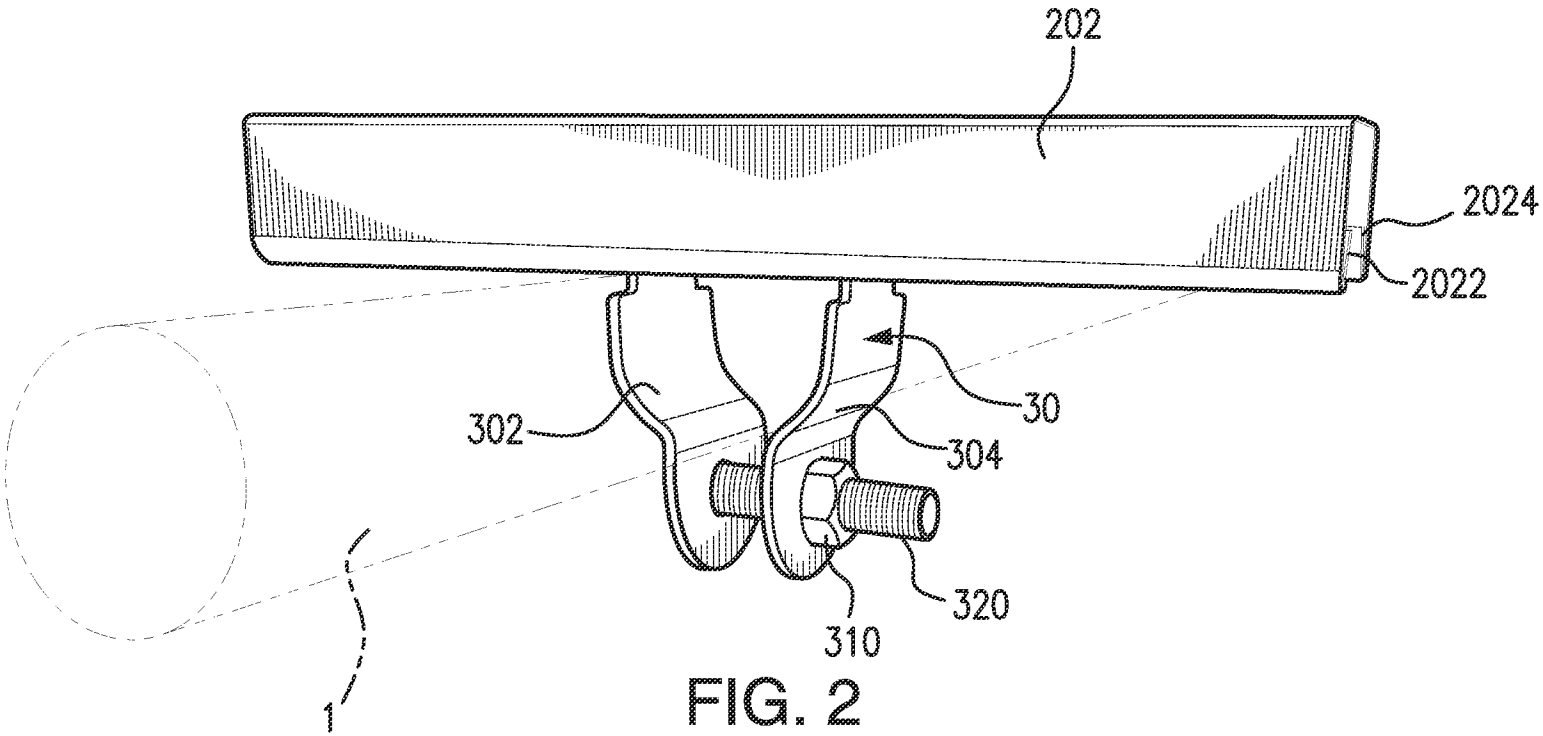
FIG. 2 is a frontal perspective view of a portion of the embodiment of FIG. 1, illustrating an example of hanging hardware mounted thereto.
Figure 3A:
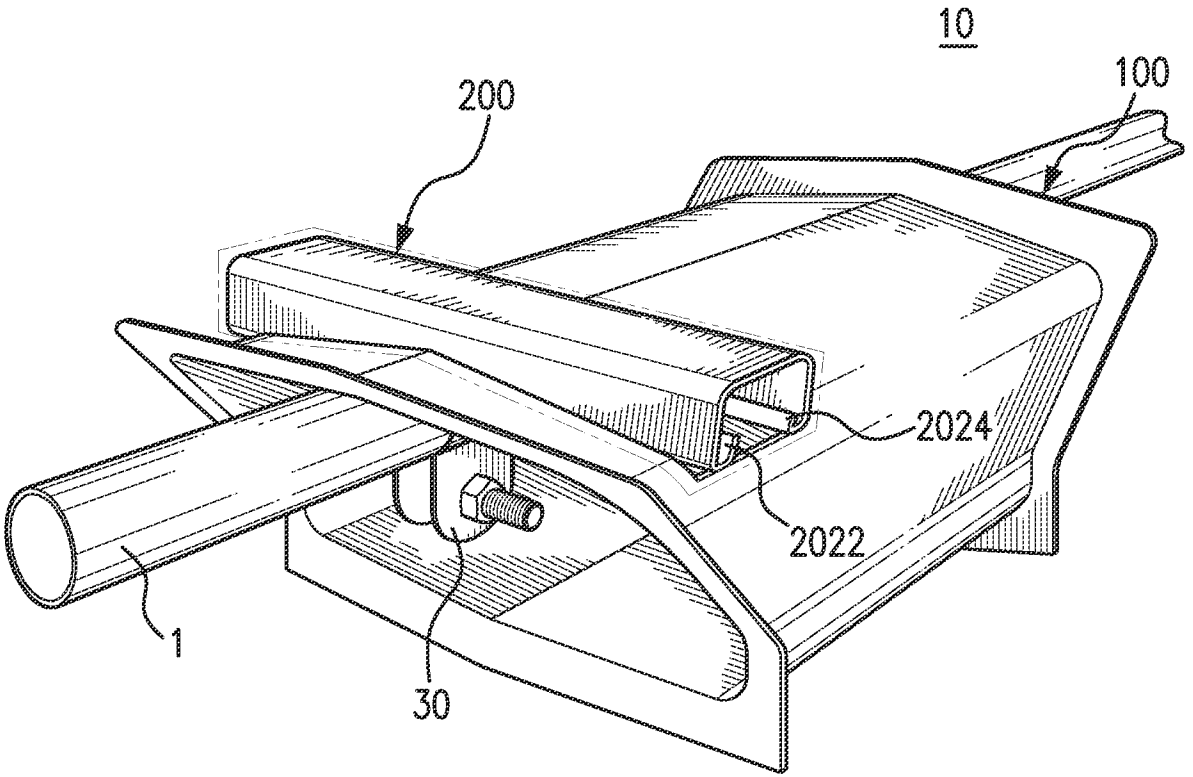
FIG. 3A is an upper frontal perspective view of the embodiment of FIG. 1, illustrating an example of hanging hardware mounted thereto to hold a sample implement.
Figure 3B:
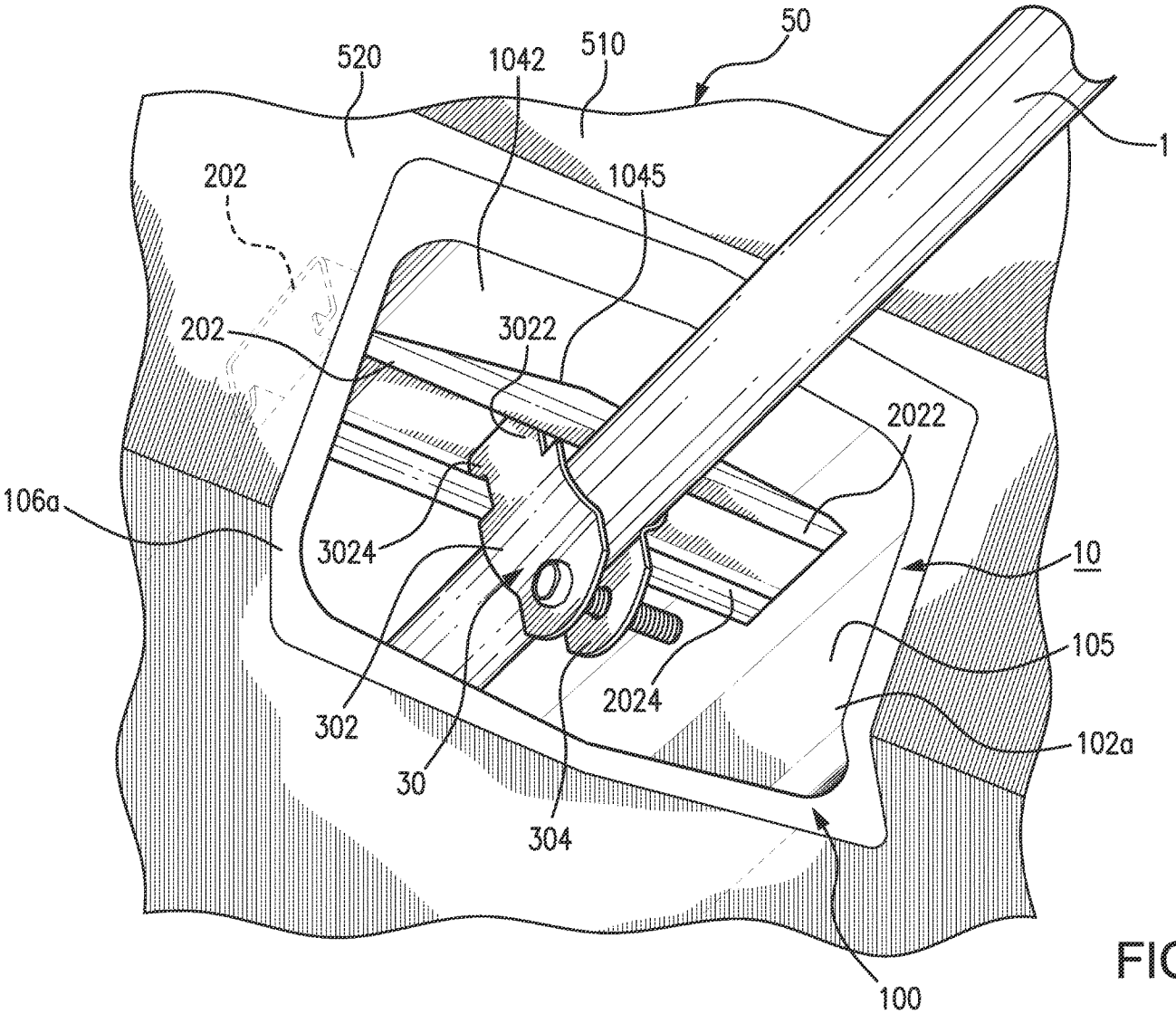
FIG. 3B is a lower frontal perspective view, partially cut away, of the embodiment of FIG. 1 as illustrated in FIG. 3A, shown integrated into an illustrative structural member.
Figure 4:
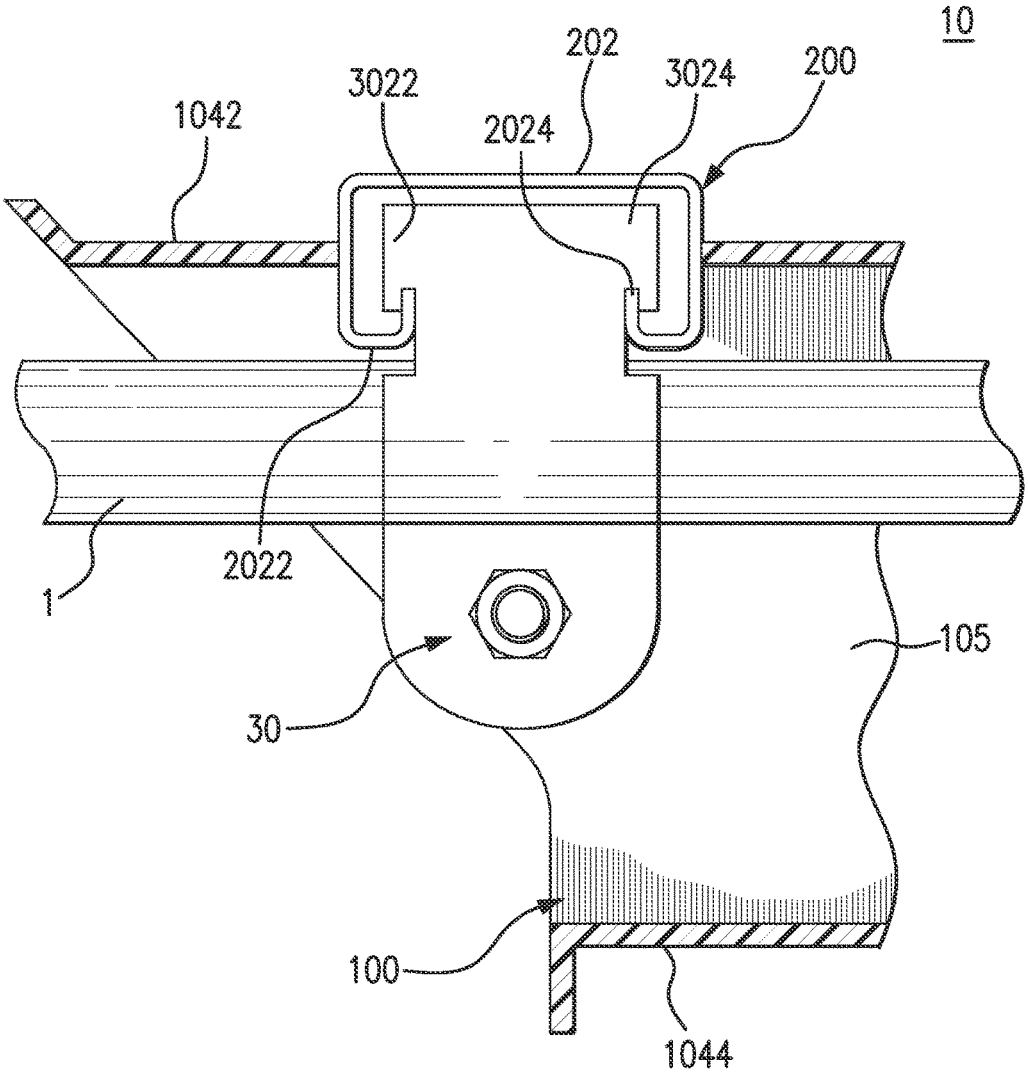
FIG. 4 is a side sectional view, partially cut away, of a portion of the embodiment of FIG. 1.

Referring now to FIG. 2-4, certain aspects of the blockout apparatus 10 during use, as implemented in a T-beam structural member are illustrated. An apparatus 10 implemented as shown in FIG. 1 is embedded within a structural member 50 which in this particular example is shown to be a pre-fabricated T-beam concrete form 50 having a top panel 510 and at least one vertical beam 520 extending therebeneath. Coupled to the strut channel engagement base 202 is a multi-piece conduit clamp hardware 30 for supporting a section of a pipe-like electrical conduit 1. The engagement base 202 may accommodate mounting/hanging hardware of other suitable type and configuration known in the art, again depending on the particular requirements of the intended application. The configuration of assembly 30 is shown for illustrative purposes only, and implementations of the blockout apparatus 10 are not limited thereto.

As shown most clearly in FIG. 3B, when a blockout apparatus 10 is embedded within the T-beam concrete form 50, its tubular body portion 100 preserves a cross-penetrating through passage 105 in the upper part of the Y-shape vertical beam 520, very near if not at the top panel 510. This allows the free passage of conduit 1 and other such implements through the vertical beam 520 that would otherwise obstruct their path.

In FIG. 3B, the gasket flange 106*a* at one longitudinal end 102*a* is shown to maintain flush, conformed contact with the surrounding surfaces of the vertical beam 520 continually about the mouth opening at the end 102*a*. The engagement base 202 is also embedded within the T-beam concrete form to extend over and across the tubular body 100. The covering 204 which may have been required during the concrete form molding process (to prevent infiltrating flow of uncured concrete material into the through passage 105) is not shown in FIG. 3B in the interests of brevity and clarity.

The engagement base 202 is seated a top the tubular body portion 100 to fill the window opening 1045 formed through its top wall 1042. The bottom parts of the engagement base 202 thus run transversely across substantially the entire width of the through passage 105. They do so near and along the top wall 1042 above that through passage 105, such that encroachment of the engagement base 202 s into the through passage 105 remains minimal. The exposed lower bottom parts of the engagement base 202 define the retention channel transversely across the top of the through passage 105 there. The retention channel preferably remains close enough to the mouth opening at the near end 102*a* of the tubular body 100, so that a user may easily access it for installation of mounting hardware 30. The engagement base 202 in this example is situated within the apparatus 10, close enough to the nearest mouth opening to afford partial longitudinal clearance beyond the bottom wall 1044 of the tubular body 100 (as most clearly illustrated in FIG. 4).

During use, then, when a user arrives at a building structure constructed using T-beam structural members 50 integrated with blockout apparatuses 10 as shown, he/she need only engage mounting hardware 30 to the engagement base 202 that is built in, already in place on each apparatus 10, running across the top of its through passage 105 near a mouth opening. Without the trouble and expense (in terms of time, money, and energy) of pre-installing support anchors to nearby concrete surfaces, the user may conveniently just hang the opposing clamp pieces 302, 304 to the built in retention channel overhead. For example, the hooking portions 3022, 3024 of each clamp piece may be clipped to an opposed lip 2022, 2024 about the retention channel and secured in place. Preferably, ample clearance for the required manipulation of the clamp pieces 302, 304 is provided by the engagement base's accessible location adjacent the nearest mouth opening into the through passage 105.

Once the clamp pieces 302, 304 are thereby hung from the opposed retention lips 2022, 2024, an electrical conduit 1 or other implement may be passed between the clamp pieces 302, 304 before they are tightened together. Suitable fastening measures like the mated nut and bolt combination 310, 320 shown may be effectively employed with little effort in this regard.

This avoids the considerable effort and delay typically involved in conventional approaches, where the user would have to prepare sufficient anchoring points before any mounting hardware may even be installed on the T-beam structural members. A user would typically drill a bore into the surface of the planar top panel overhead, away from a vertical beam, then install a concrete anchor or other securement device onto the top panel through the bore. Only after the anchor/securement device is firmly emplaced, would the user be able to install the necessary hardware for mounting/hanging a given implement.

Figure 5A:
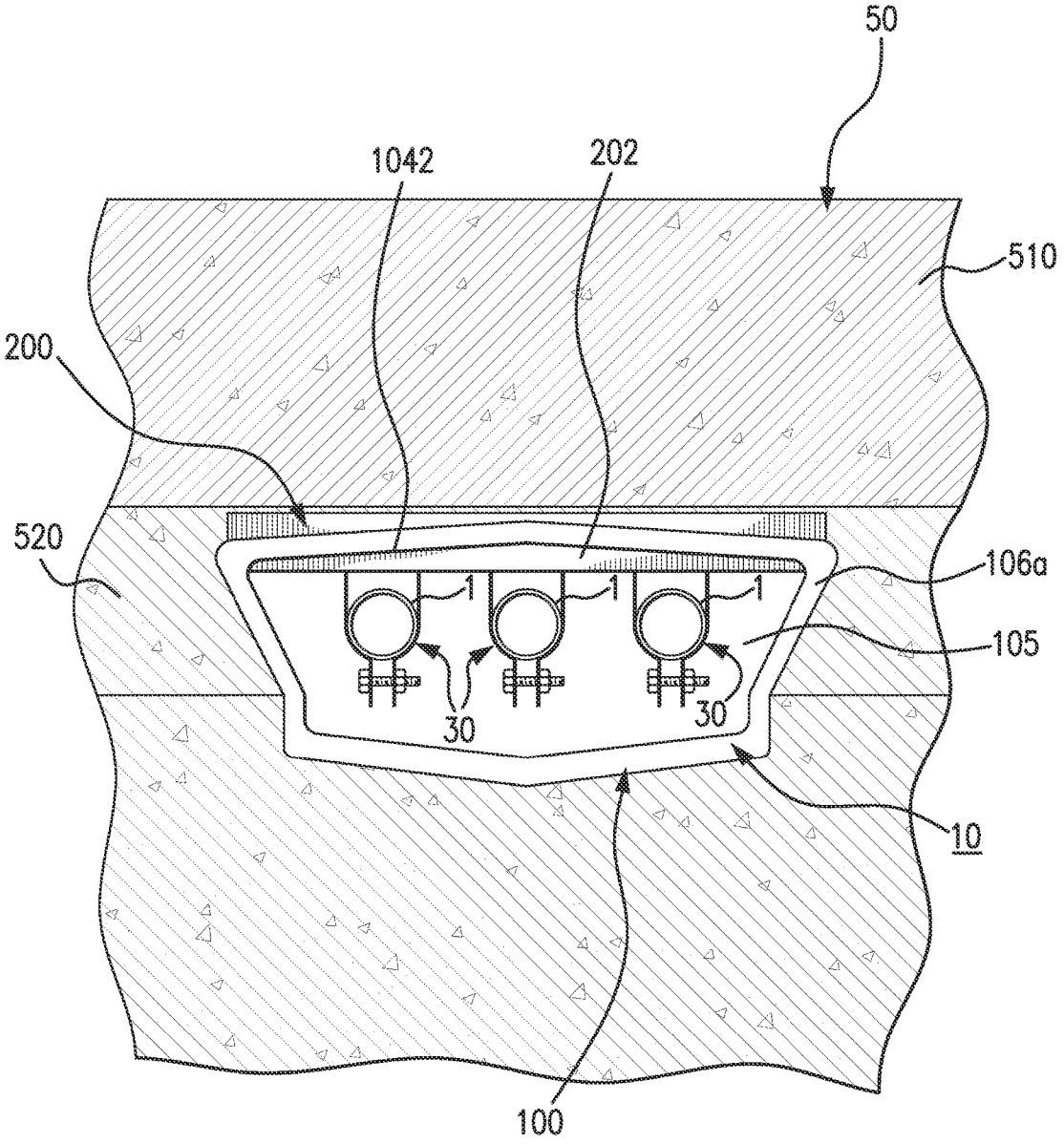
FIG. 5A is a frontal elevational view, partially cut away, of the embodiment of FIG. 1 as illustrated in FIG. 3A, shown integrated into an illustrative structural member, and with additional hanging hardware mounted thereto to hold additional implements.
Figure 5B:
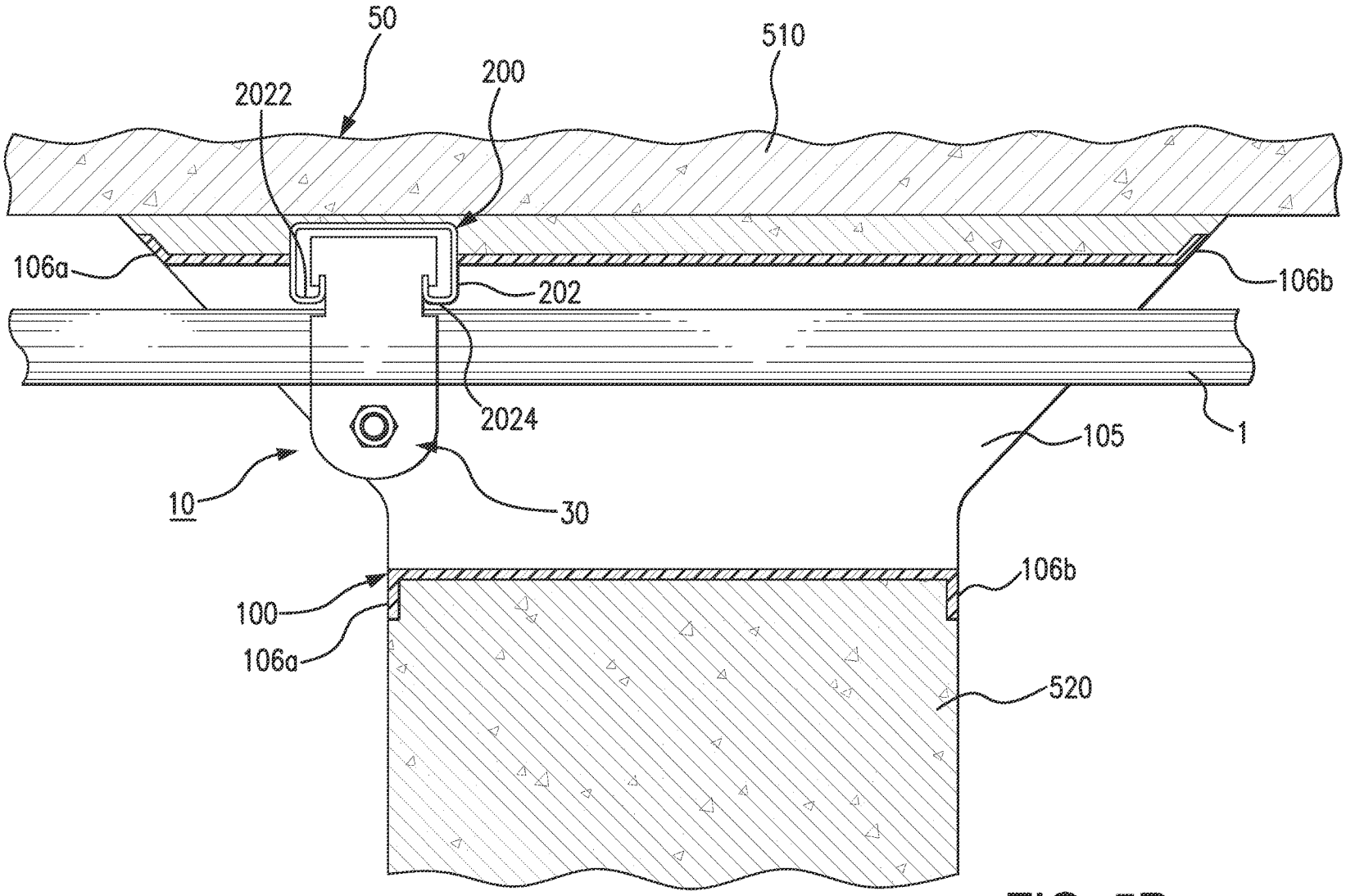
FIG. 5B is a side sectional view, partially cut away, of the embodiment of FIG. 1 as illustrated in FIG. 5A.

Referring now to FIGS. 5A-5B, there is shown an implementation of blockout apparatus 10 as integrated within a T-beam concrete form 50 as shown in FIGS. 2-4, but with a plurality of conduits 1 mounted with respective hanging hardware 30. In this case, the blockout apparatus 10 is so configured that there is ample room within its through passage 105 to accommodate parallels runs of three conduit sections 1 alongside one another. Each of the conduit sections is securely mounted to the integrated engagement base 202 by its own conduit clamp assembly 30 much as illustrated in FIGS. 2-4. Depending on the particular requirements of the particularly intended application, various other combinations of implements like conduits 1 may be similarly accommodated through the passage 105 secured by suitable hardware directly to the hardware mounting portion 200 integrated with the blockout apparatus 10 in structural member 50.

A point of note for the particular application illustrated in FIGS. 2-5B is that applicable construction and/or engineering requirements (such as applicable building codes, or mechanical, electrical, plumbing, and other codes and standards) may require the implements in question (like the electrical conduits 1 shown) to be suspended no more than a certain maximum distance away from the ceiling surface overhead. It may be necessary in certain applications to form the blockout apparatus 10 so that the hardware mounting provided by the engagement base 202 occurs at a level close to, if not flush with, the ceiling surface defined by a structural member's top panel 510.

In the implementations illustrated in FIGS. 3A-5B, both the tubular body portion 100 and hardware mounting portion 200 are fully embedded within the vertical beam 520 of the structural member 50. One or both of these portions 100, 200 may be disposed higher up within the structural member 50 than shown, where necessary, to minimize the spacing between a mounted implement and the ceiling surface. The upper part of the engagement base 202, for example, may be embedded within the structural member 50 to extend into the top panel 510 in certain alternate implementations. A corresponding upward displacement of the tubular body portion 100 is not without limits, however, given the upward extension of the gasket flange 106*a* extending along the open mouth edge of the tubular body portion's top wall 1042. At some point, the uppermost extension of the gasket flange 106*a* encounters the ceiling (that is, the overhanging bottom surface of the top panel 510). If this imposes an unacceptable limit in a given application, remedial measures may be employed, such as truncating the gasket flange 106*a* to avoid obstructive interference with the ceiling. Alternatively, the poured mold material of the top panel 510 may simply be permitted to overflow the upper edge of the gasket flange 106*a*, so that it is embedded into the top panel 510. But this would require sufficient safeguards to prevent the mold material from unduly infiltrating the through passage 105 during the molding process.

Figure 6A:
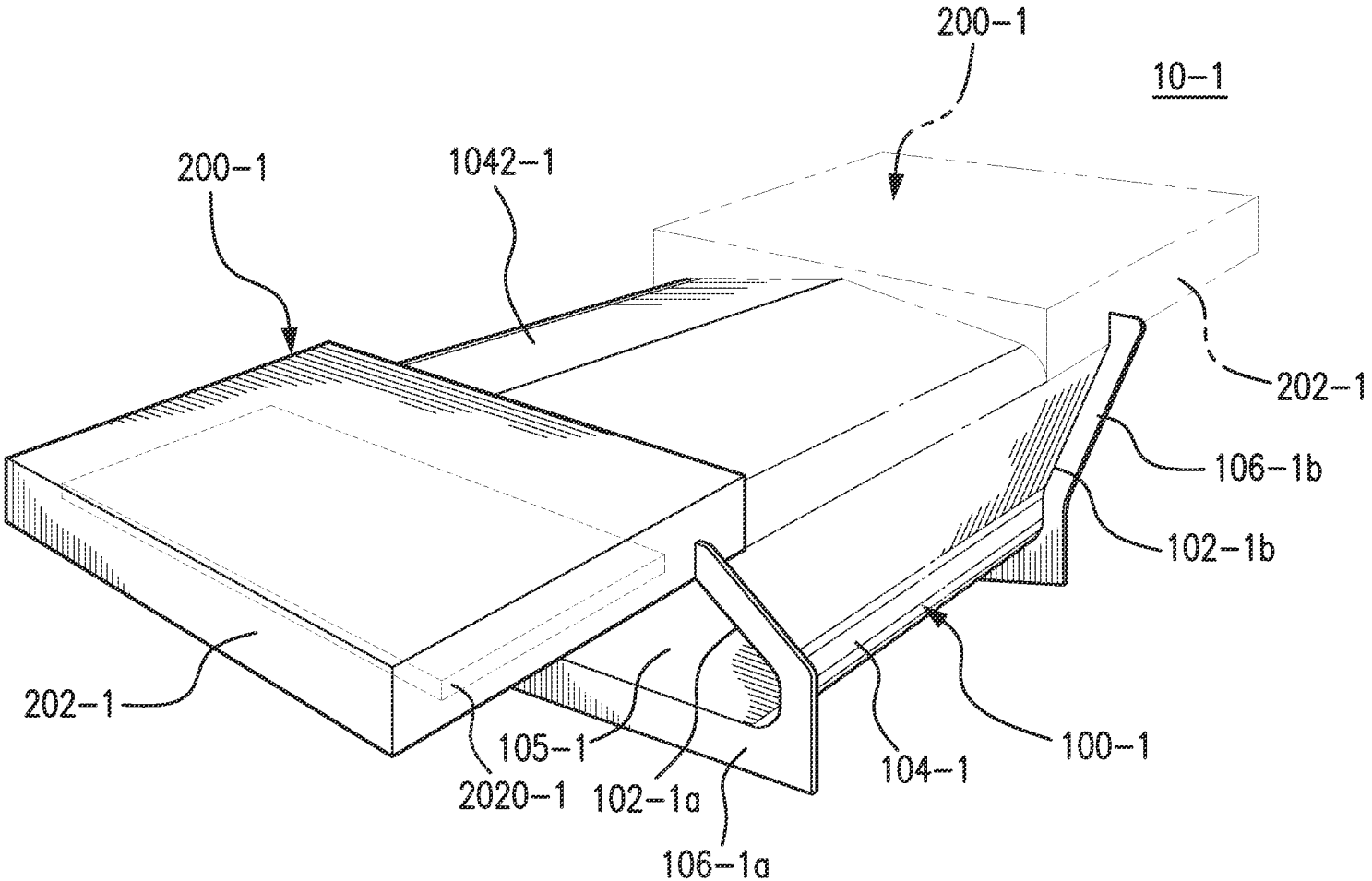
FIG. 6A is an upper frontal perspective view of an apparatus formed in accordance with another exemplary embodiment the present invention.
Figure 6B:
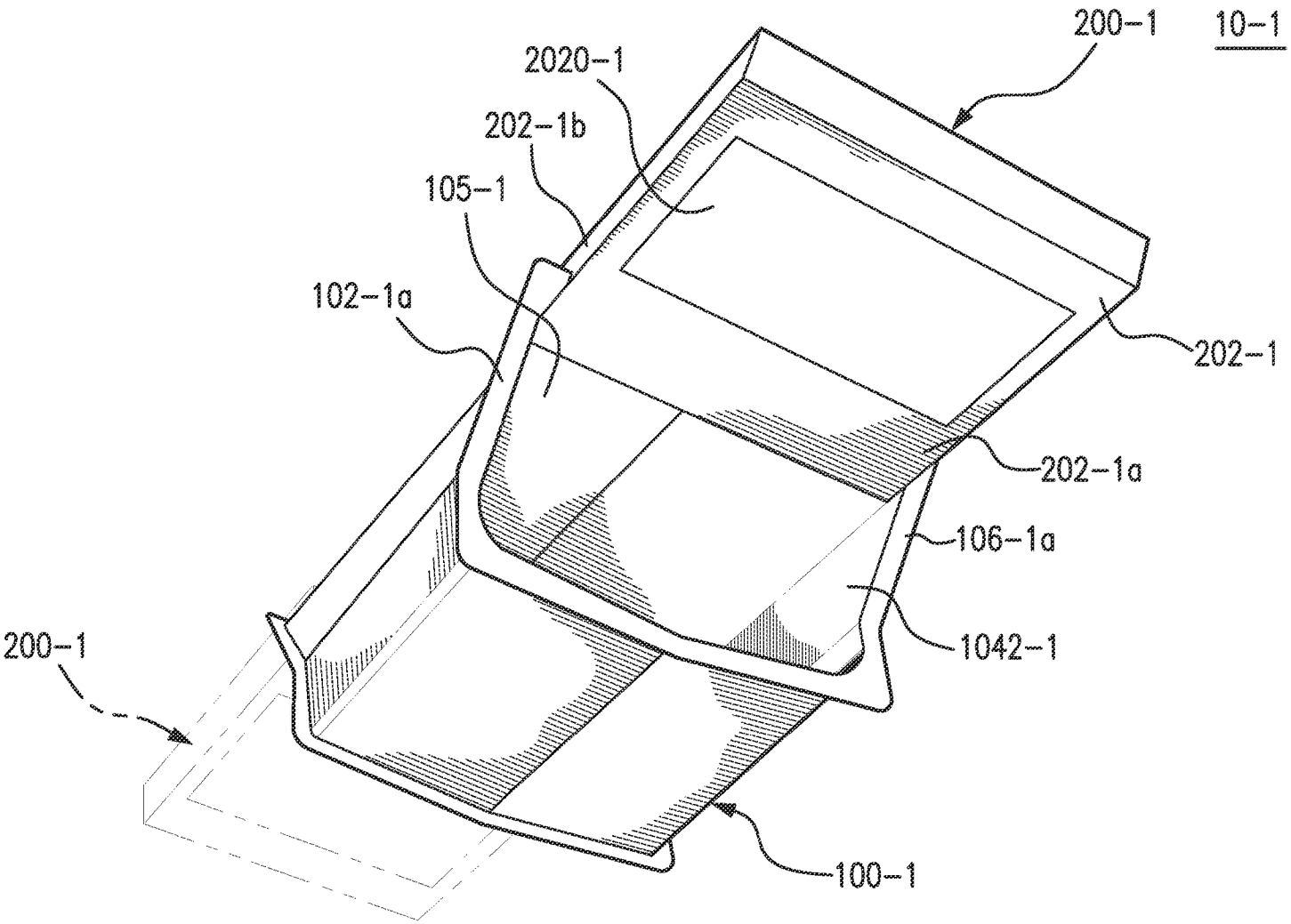
FIG. 6B is a lower frontal perspective view of the embodiment of FIG. 6A.

Referring now to FIGS. 6A-6B, there is shown a blockout apparatus 10-1 formed in accordance with another exemplary embodiment of the present invention. Much as with the embodiment of FIG. 1, the blockout apparatus 10-1 is configured to be a least partially embedded within a structural member such as of the T-beam type described in preceding paragraphs. The blockout apparatus 10-1 includes a tubular body portion 100-1 whose shape, contour, dimensional configuration, and other structural features are suitably selected to accommodate the particular features of the structural member into which it is to be incorporated. For simplicity (and without limitation), the tubular body portion 100-1 is shown to be similar in general structure to the tubular body 100 of the blockout apparatus embodiment shown in FIGS. 1-5B, except as otherwise noted. But the blockout apparatus 10-1 in this embodiment includes at least one hardware mounting portion 200-1 notably different in configuration from the corresponding portion 200 of the blockout apparatus 10 in the preceding embodiment.

The hardware mounting portion 200-1 in this embodiment includes an engagement base 202-1 different both in structural configuration and positioning relative to the tubular body portion 100-1. The hardware mounting portion 200-1 includes an engagement base 202-1 that is structurally augmented relative to the tubular body portion 100. For example, the engagement base 202-1 is stepped in thickness relative to the tubular body portion's top wall in 1042-1. This yields a thickened block structure that provides a more substantial base of support material to which various mounting/hanging hardware may be directly fastened via screw(s), staple(s), or other such fastening measures.

The tubular body portion 100-1 in this and other embodiments may be formed of any suitable material known in the art having sufficient rigidity and strength to be embedded within a structural member without undue compromise. Preferably, the tubular body portion 100-1 is formed of a plastic, polyurethane, or other such material providing optimal combination of cost and performance. For simplicity of manufacture, the hardware mounting portion 200-1 of this embodiment is preferably, though not necessarily, formed of the same or similar material as the tubular body portion 100-1. In certain embodiments, it may be preferable also to form this hardware mounting portion 200-1 integrally with the tubular body portion 100-1.

In addition to the structural augmentation, the engagement base 202-1 of the hardware mounting portion 200-1 is situated in front-swept manner relative to the tubular body portion's intermediate section 104-1. This affords several advantages. First, this provides an awning-type overhang structure which extends longitudinally beyond the confines of the tubular body portion's wall surfaces that surround the through passage 105-1. This not only leaves unobstructed clearance for a user to work unhindered in attaching the given mounting/hanging hardware, it also allows for practically unrestricted extension of the engagement base 202-1 in plainer span both longitudinally and laterally.

Moreover, since the awning-type overhang formed by the engagement base 202-1 naturally shields against the flow of mold material down into the through passage 105-1 (during the structural member's molding process about the blockout apparatus 10-1), the engagement base 202-1 obviates the need for separate shielding measures above the nearest mouth opening of that through passage 105-1. Indeed, the engagement base 202-1 replaces a segment of the protective gasket flange 106-1*a* that would otherwise extend above the mouth. An added advantage is that its flat, low profile structure permits the engagement base 202-1 to be embedded in the top panel of the given structural member (510 in the structural member 50 illustrated in FIG. 3B, for instance) without undue encroachment. Hence, the mounting surface presented by the engagement base would be openly accessible to the user from below, at or very near the ceiling level—that is, substantially flush with the lower surface of the surrounding top panel of the structural member (50 in FIG. 3B).

The risk of concrete or other molding material undesirably falling into the through passage of the tubular body portion from above—which could hinder similarly raised placement of the engagement base in the preceding embodiment—is avoided in this embodiment. With the engagement base 202-1 situated as an overhang above the mouth opening at the tubular body portion's longitudinal end 102-1*a* as shown, the gasket flange 106-1*a* at that end is preferably formed to extend along just the side and bottom edges of the mouth opening and extend at least partially up the opposites sides 202-1*b* of the engagement base. The gasket flange 106-1*a* thus continues to shield against mold material infiltration into the through passage 105-1 from surrounding side and bottom areas during the structural member molding process.

As indicated in broken line format, a second hardware mounting portion 200-1 may be similarly formed at the opposing longitudinal end 102-1*b*. The gasket flange 106-1*b* would then be similarly formed about the side and bottom edges of the mouth opening at that end to terminate against the sides 202-1*b* of the second engagement base 202-1 there.

The strength of hold provided by an engagement base 202-1 for a mounting/hanging device fastened directly thereto will depend in part on the material composition of that engagement base, and the depth of fastener penetration afforded by its thickness dimension. To reinforce its strength of hold, the structural augmentation measures provided for the engagement base 202-1 preferably though not necessarily include an insert member 2020-1. The insert member 2020-1 is at least partially embedded in the thickened wall segment formed by the engagement base 202-1, and is preferably formed of a material composition that is greater in strength and density than the material composition of the surrounding thickened wall segment. The insert member 2020-1 may be substantially planar in contour, as illustrated, or may be of any other alternative shape, size, and contour suitable for the intended application.

Figure 7:
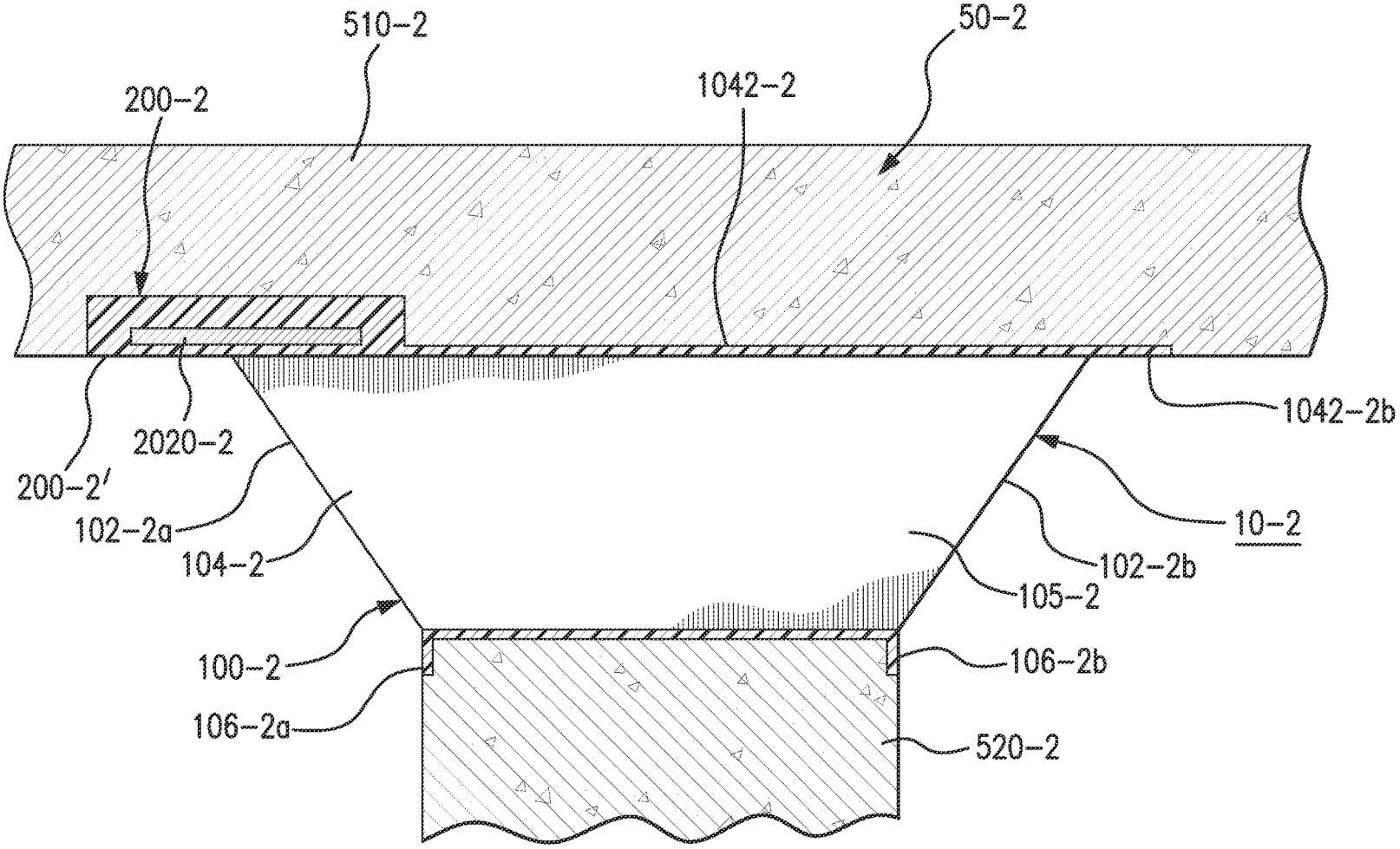
FIG. 7 is a side sectional view, partially cut away, of an apparatus formed in accordance with yet another exemplary embodiment the present invention, shown integrated into an illustrative structural member.

When partially embedded, the bottom face of this insert member 2020-1 is openly exposed to the user from beneath, as illustrated in FIG. 6B. In certain other alternate embodiments (such as illustrated in FIG. 7), the insert member 2020-1 may be fully embedded within the thickened wall segment, such that a continuous uninterrupted bottom face of the thickened wall segment is presented to the user for access from below. Where multiple hardware mounting portions 200-1 are employed in the blockout apparatus 10-1—disposed at opposing longitudinal ends of the tubular body portion 100-1—the insert member 2020-1 may be integrated into one, both, or neither of the portions 200-1, depending on the particular requirements of the intended application.

The insert member 2020-1, when employed, may be formed of any suitable composition known in the art.

Preferably, though not necessarily, it may be formed of a metallic composition that may be readily drilled through or penetrated by fasteners of the type to be employed in the intended application.

Turning next to FIG. 7, there is illustrated a blockout apparatus 10-2 formed in accordance with yet another exemplary embodiment of the present invention. In this embodiment, the blockout apparatus 10-2 is formed with but one hardware mounting portion 200-2 integrally formed at one end 102-2*a* of the tubular body portion 100-2. As in the embodiment of FIGS. 6A-6B, the engagement base 200-2 at this longitudinal end 102-2*a* forms a thickened wall segment that is situated in front-swept manner to extend longitudinally beyond the mouth opening of the through passage 105-2 at that end. The thickened wall segment, however, is front-swept to a lesser degree than in the embodiment of FIGS. 6A-6B. That is, more of the thickened wall segment remains extending over the through passage 105-2 within the tubular body portion's surrounding walls. An insert member 2020-2 is preferably employed in this embodiment as well, but is fully embedded in the thickened wall segment as shown.

The blockout apparatus 10-2 is preferably integrated as shown into a T-beam concrete form 50-2 of any suitable configuration known in the art. The thickened wall segment of the engagement base 200-2 is embedded into the top panel 510-2 of the form 50-2, such that the substantially planar mounting surface 200-2' it defines underneath is disposed substantially flush with the surrounding bottom face of the concrete form's top panel 510-2. At the opposite end 102-2*b*, the top wall 1042-2 of the tubular body portion 100-2 is extended beyond the mouth opening as shown to form a protective awning-type structure at that end. This obviates an upper segment of gasket flange 106-2*a* above the mouth opening.

The awning structure 1042-2*b* at the opposite end 102-2*b* is without the structural augmentation provided at the end 102-2*a*, but its extension beyond the mouth opening shields against infiltration of concrete into the through passage 105-2 during the concrete form's molding process. The remaining portions of the gasket flange 106-2*a*, 106-2*b* at the respective ends 102-2*a*, 102-2*b* are preferably formed as in preceding embodiments to guard against other infiltrating flow of concrete from the surrounding areas of the vertical beam 520-2 during that molding process.

Referring now to FIG. 8, there is shown one illustrative example of a modular structural member 50-1 integrated with a plurality of blockout apparatuses 10-1 formed in accordance with the embodiment of FIGS. 6A-6B. In this particular example, each structural member 50-1 is prefabricated with a substantially planar top panel 510-1 from which a pair of vertical beams 520-1 extend downward to each form a T-beam configuration. A pair of offset cross passages are preserved through each vertical beam 520-1 by respective blockout apparatuses 10-1 spaced one from the other along a lateral length of the vertical beam. Preferably, the blockout apparatuses 10-1 traversing one vertical beam 520-1 are sufficiently aligned with corresponding blockout apparatuses 10-1 traversing an adjacent vertical beam 520-1, so that they may cooperatively pass continuous extended runs of rigid implements like electrical conduits and plumbing pipes therethrough. The actual locations of one or more blockout apparatuses 10-1 on each vertical beam 520-1 may be varied for different implementations according to the particular requirements of the intended application.

A plurality of such modularly-formed T-beam structural members 50-1 may be joined together to construct, for instance, a subfloor or simply a ceiling level. Additional structural members 50-1' may be assembled to the structural member 50-1 by edge-aligning along any one of the edges 50-1*a*, 50-1*b*, 50-1*c*, 50-1*d* shown. In FIG. 8, the additional structural member 50-1' illustrated is assembled by adjoining its top panel 510-1' to the top panel 510-1 of the structural member 50-1 along the indicated edge 50-1*b*. Where additional structural members 50-1' are to be attached along the edges 50-1*c*, 50-1*d* of the structural member 50-1, its vertical beams will align end-to-end with the vertical beams 520-1 of the structural member 50-1.

Figure 9:
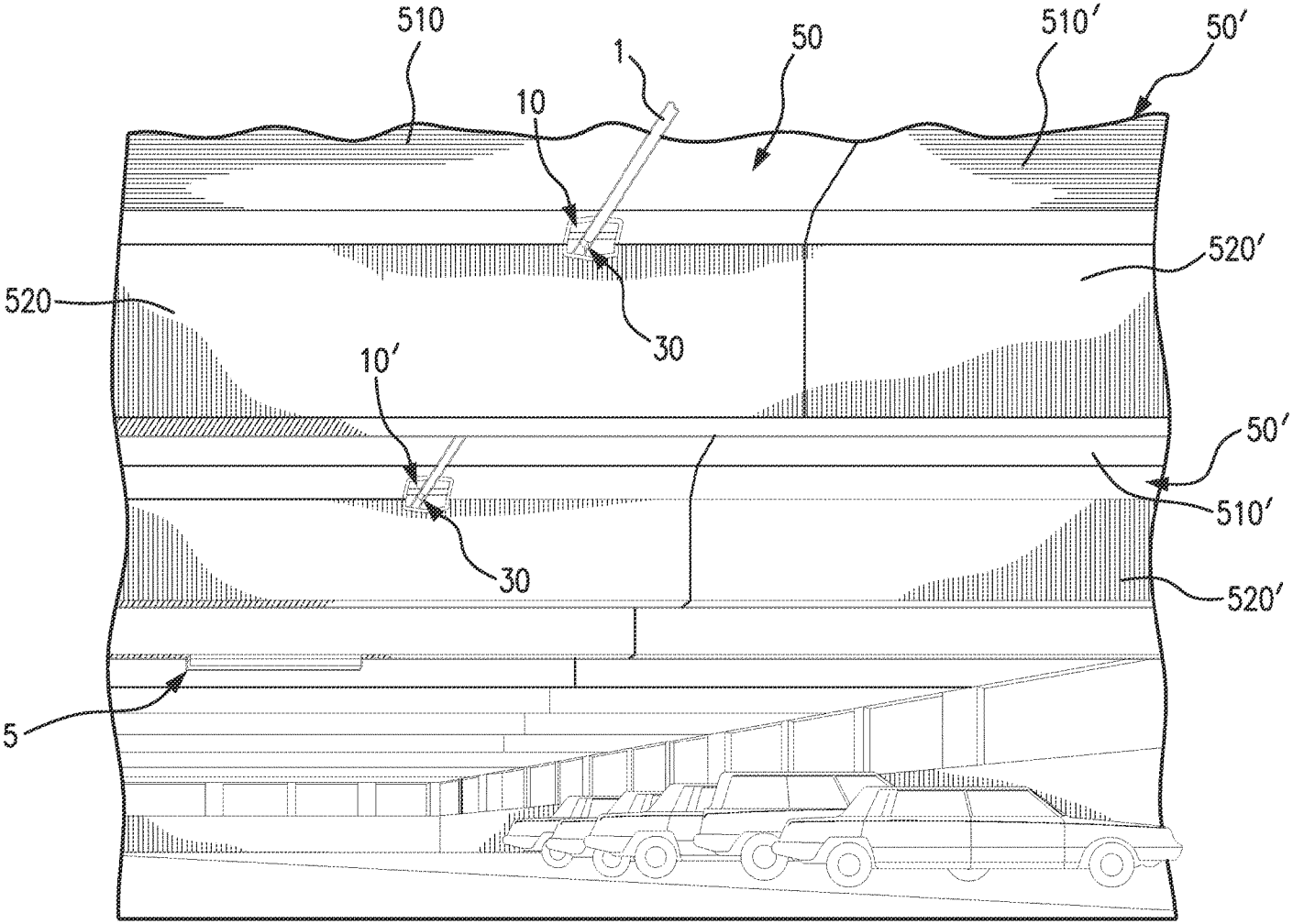

FIG. 9 illustrates an example of one application, namely a parking garage application, where a modular structural member 50 is so assembled with a plurality of additional structural members 50' to construct an elevated floor/ceiling level extending over one vehicle parking level. In this example, the vertical beams 520, 520' of the assembled array of structural members 50, 50' is traversed by at least one blockout apparatus 10, 10' integrated in accordance with the embodiment illustrated in FIGS. 1-4. The blockout apparatuses 10, 10' of consecutively spaced vertical beams 520, 520' are sufficiently aligned that multiple segments of electrical conduit 1 may be conveniently mounted thereto via respective hanging hardware 30 to form a straight, continuous run along the ceiling. The ceiling, of course, is defined by the collective bottom surfaces of the top panels 510, 510', and each run of electrical conduit 1 traverses the intervening vertical beam 520, 520' through the aligned cross passages preserved by the blockout apparatuses 10, 10'. Electrical wiring to power, for instance, a light fixture 5 mounted to one of the structural members 50, 50' may then be passed through one or more runs of electrical conduit 1 installed in this manner.

As noted in preceding paragraphs, no pre-installation preparatory work, such as drilling into the top panels, or even into the vertical beams of the structural members themselves, is rendered altogether unnecessary for installation of implements like conduit segments 1. The user need only install the hanging hardware 30 directly on to the engagement base of the hardware mounting portion already built into each blockout apparatus 10, 10', then accordingly position and secure the implement via the hardware.

Although this invention has been described in connection with specific forms and embodiments thereof, it will be appreciated that various modifications other than those discussed above may be resorted to without departing from the spirit or scope of the invention as defined in the appended claims. For example, equivalent elements may be substituted for those specifically shown and described, certain features may be used independently of other features, and in certain cases, particular applications of elements may be reversed or interposed, all without departing from the spirit or scope of the invention as defined in the appended claims.

What is claimed is:

1. A blockout apparatus for preserving a through passage in a structural member formed thereabout, comprising:

a tubular body portion having first and second ends defining mouth openings and an intermediate section extending therebetween to define a longitudinal through passage, said tubular body portion including a gasket flange formed at least partially about each of said first and second end mouth openings to project transversely outward therefrom; and, a hardware mounting portion integrated with said tubular body portion, said hardware mounting portion defining an engagement base disposed in open communication with the through passage, said engagement base being structurally augmented relative to said tubular body portion to retentively engage preselected mounting hardware for weight bearing support of an implement therefrom;

wherein said engagement base includes a strut channel member passed through an opening formed in said intermediate section of said tubular body portion, said strut channel member defining a recessed channel and a pair of opposed lips extending thereover to form a retention track.

2. The blockout apparatus as recited in claim 1, wherein said engagement base of said hardware mounting portion is configured to protrude upward from a top surface of said intermediate section of said tubular body portion.

3. A blockout apparatus for preserving a through passage in a structural member formed thereabout, comprising:

a tubular body portion having first and second ends defining mouth openings and an intermediate section extending therebetween to define a longitudinal through passage, said tubular body portion including a gasket flange formed at least partially about each of said first and second end mouth openings to project transversely outward therefrom; and, a hardware mounting portion integrated with said tubular body portion, said hardware mounting portion defining an engagement base disposed in open communication with the through passage, said engagement base being structurally augmented relative to said tubular body portion to retentively engage preselected mounting hardware for weight bearing support of an implement therefrom;

wherein said engagement base forms a thickened wall segment stepped in thickness over an adjacent wall segment of said intermediate section;

wherein said engagement base includes an insert member at least partially embedded in said thickened wall segment, said insert member having a material composition greater in density than said thickened wall segment.

4. The blockout apparatus as recited in claim 3, wherein said engagement base projects from the intermediate section longitudinally outward beyond at least one of said first and second ends of said tubular body portion to terminate at an awning extension protectively suspended over said mouth opening thereof.

5. The blockout apparatus as recited in claim 3, wherein said hardware mounting portion defines a pair of said engagement bases projecting respectively in opposite directions from said first and second ends of said tubular body portion.

6. The blockout apparatus as recited in claim 3, wherein said engagement base of said hardware mounting portion is configured to protrude upward from a top surface of said intermediate section of said tubular body portion.

7. The blockout apparatus as recited in claim 3, wherein said tubular base portion is formed of a non-metallic composition, and said insert member of said hardware mounting portion engagement base includes a planar metallic component.

8. A blockout apparatus for preserving a through passage in a structural member formed thereabout, comprising:

a tubular body portion having first and second ends defining mouth openings and an intermediate section extending therebetween to define a longitudinal through passage, said tubular body portion including a gasket flange formed at least partially about each of said first and second end mouth openings to project transversely outward therefrom; and, a hardware mounting portion integrated with said tubular body portion, said hardware mounting portion defining an engagement base disposed in open communication with the through passage, said engagement base being structurally augmented relative to said tubular body portion to retentively engage preselected mounting hardware for weight bearing support of an implement therefrom;

wherein said engagement base includes an insert member having a material composition greater in density than said intermediate section of said tubular body portion;

wherein said engagement base projects from the intermediate section longitudinally outward beyond at least one of said first and second ends of said tubular body portion to terminate at an awning extension protectively overhanging said mouth opening thereof.

9. The blockout apparatus as recited in claim 8, wherein:

said intermediate section includes a top wall spaced from a bottom wall by a pair of laterally spaced side walls extending therebetween;

said engagement base traverses the longitudinal through passage substantially along said top wall of said intermediate section; and, said gasket flange flares outward from each of said side and bottom walls of said intermediate section at the least one of said first and second tubular body portion ends.

10. The blockout apparatus as recited in claim 8, wherein said tubular base portion is formed of a non-metallic composition, and said insert member of said hardware mounting portion engagement base includes a planar metallic component.

11. The blockout apparatus as recited in claim 8, wherein said engagement base of said hardware mounting portion is configured to protrude upward from a top surface of said intermediate section of said tubular body portion.

* * * * *